US009114624B2

(12) United States Patent
Yamamoto et al.

(10) Patent No.: US 9,114,624 B2
(45) Date of Patent: Aug. 25, 2015

(54) LIQUID DISCHARGE HEAD, LIQUID DISCHARGE APPARATUS, AND LIQUID FILLING METHOD

(75) Inventors: Akira Yamamoto, Yokohama (JP); Toshiaki Hirosawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 13/104,694

(22) Filed: May 10, 2011

(65) Prior Publication Data

US 2011/0279607 A1 Nov. 17, 2011

(30) Foreign Application Priority Data

May 14, 2010 (JP) ..... 2010-112364

(51) Int. Cl.
*B41J 2/175* (2006.01)
*B41J 2/14* (2006.01)
*B41J 2/155* (2006.01)

(52) U.S. Cl.
CPC ..... *B41J 2/17563* (2013.01); *B41J 2/14024* (2013.01); *B41J 2/155* (2013.01); *B41J 2002/14362* (2013.01); *B41J 2002/14403* (2013.01); *B41J 2202/12* (2013.01); *B41J 2202/19* (2013.01); *B41J 2202/20* (2013.01)

(58) Field of Classification Search
USPC ..... 347/85, 86, 87, 92, 93, 56, 66, 65
See application file for complete search history.

(56) References Cited

U.S. PATENT DOCUMENTS

| | | | | |
|---|---|---|---|---|
| 7,413,300 | B2 * | 8/2008 | Von Essen et al. | 347/89 |
| 7,448,741 | B2 * | 11/2008 | von Essen | 347/93 |
| 7,537,318 | B2 * | 5/2009 | Fujii et al. | 347/66 |
| 7,699,449 | B2 * | 4/2010 | Yoshino et al. | 347/85 |
| 8,480,214 | B2 * | 7/2013 | Tsubaki | 347/85 |
| 2005/0285913 | A1 * | 12/2005 | Yoshino et al. | 347/85 |
| 2010/0053279 | A1 * | 3/2010 | Tamaki | 347/85 |
| 2010/0097433 | A1 * | 4/2010 | Mukai et al. | 347/93 |

FOREIGN PATENT DOCUMENTS

| | | | |
|---|---|---|---|
| JP | 2006-123188 | A | 5/2006 |
| JP | 2007-144732 | A | 6/2007 |
| JP | 2008-087373 | A | 4/2008 |
| JP | 2009-184202 | A | 8/2009 |

* cited by examiner

*Primary Examiner* — Matthew Luu
*Assistant Examiner* — Lily Kemathe
(74) *Attorney, Agent, or Firm* — Canon USA Inc IP Division

(57) ABSTRACT

A liquid discharge member includes discharge ports, and a first opening and a second opening that communicate with the discharge ports. A liquid supply member includes a first filter disposed in a gravitational direction and in a disposed direction, a first containing chamber containing the first filter, a second containing chamber containing the second filter, a first flow path connecting the first opening and the first containing chamber, and a second flow path connecting the second opening and the second containing chamber. The second filter and the first and the second flow path are disposed in an area between a surface perpendicular to the disposed direction and parallel to the gravitational direction and going through one end of the length of the first filter and a surface parallel to the first surface and going through the other end of the length of the first filter in the disposed direction.

16 Claims, 19 Drawing Sheets

LIQUID DISCHARGE HEAD, LIQUID DISCHARGE APPARATUS, AND LIQUID FILLING METHOD

BACKGROUND OF THE INVENTION

1. Field of the Invention

The present invention relates to a liquid discharge head for discharging a liquid, a liquid discharge apparatus for discharging a liquid using the liquid discharge head, and a liquid filling method for filling the liquid discharge head with a liquid.

2. Description of the Related Art

Known inkjet recording heads (hereinafter referred to as recording heads) representing a liquid discharge head for discharging a liquid include a recording head having two flow paths enabling ink circulation between a recording head and an ink tank (liquid storage chamber), as discussed in Japanese Patent Application Laid-Open No. 2008-087373. A recording head illustrated in FIG. 4 discussed in Japanese Patent Application Laid-Open No. 2008-087373 includes a filter (215) arranged in a flow path for supplying ink to a discharge port for discharging ink, and a filter (216) arranged in a flow path for guiding ink, which has not been discharged, into an ink tank. The filter (215) arranged in the flow path for supplying ink has a larger area than the filter (216) to reduce a pressure loss by the filter (215), reduce a possibility that ink is not supplied, i.e., defective ink supply occurs, and maintain an ink supply characteristic.

The recording head discussed in Japanese Patent Application Laid-Open No. 2008-087373 is formed by joining a discharge element (150) (liquid discharge member) having a discharge port provided thereon and an ink storage case (210) (liquid supply member) having a filter provided therein.

In a liquid discharge head formed by joining a liquid discharge member and a liquid supply member including a flow path and a filter, when the liquid expansion coefficient of the liquid discharge member and the linear expansion coefficient of the liquid supply member differ from each other, the difference generates a stress in a joined portion between both the joined members. The joined portion may be deformed by the stress. The larger the area of the joined portion between both the members, the greater this problem becomes.

Particularly, in a full-line liquid discharge head in which ink discharge ports are arranged in a range corresponding to the width of a recording medium in a direction crossing a direction in which the recording medium is conveyed, the length of the liquid discharge member in a direction in which the ink discharge ports are disposed is large. When the length of the liquid supply member is similar to the length of the liquid discharge member, as in a case of the liquid discharge head discussed in Japanese Patent Application Laid-Open No. 2008-087373, the area of the joined portion between both the members is further increased so that the joined portion may be deformed.

SUMMARY OF THE INVENTION

The present invention is directed to a liquid discharge head including a plurality of flow paths connected to a liquid discharge member and including filters respectively connected to the flow paths, to reduce a possibility that a joined portion between a liquid discharge member and a liquid supply member is deformed while maintaining an ink supply characteristic.

According to an aspect of the present invention, a liquid discharge head includes a liquid discharge member including a plurality of discharge ports for discharging liquid, a plurality of energy generating elements generating energy for discharging liquid from the plurality of discharge ports, and a first opening and a second opening that communicate with the plurality of discharge ports, and a liquid supply member for supplying liquid to the liquid discharge member including a first filter having a filter surface with meshes formed therein, the filter surface disposed along a gravitational direction when the liquid discharge member is used and in a disposed direction in which the plurality of discharge ports are disposed, a first containing chamber that contains the first filter, a second filter having a filter surface having a smaller area than the area of the filter surface of the first filter and having meshes formed therein, a second containing chamber that contains the second filter, a first flow path that connects the first opening and the first containing chamber, and a second flow path that connects the second opening and the second containing chamber, and joined to the liquid discharge member, in which the first filter has a length in the disposed direction which is smaller than a length of the liquid discharge member in the disposed direction, and the second filter, the first flow path, and the second flow path are disposed in an area between a first surface perpendicular to the disposed direction and parallel to the gravitational direction and going through one end of the length of the first filter in the disposed direction, and a second surface parallel to the first surface and going through the other end of the length of the first filter in the disposed direction.

In the present invention, the first filter, the second filter, the first flow path, the second flow path, and the liquid discharge member, which are principal members constituting the liquid supply member, have the following relationship. More specifically, the second filter, the first flow path, and the second flow path are disposed in a range of the length of the first filter, which is smaller than that of the liquid discharge member. Since the length of the first filter is smaller than that of the liquid discharge member, the length of the liquid supply member can be reduced. As a result, the area of the joined portion between the liquid discharge member and the liquid supply member is reduced so that a good joined state between both the members can be maintained. The area of the first filter is ensured so that a sufficient ink supply characteristic can be obtained.

According to the present invention, in the liquid discharge head including the plurality of flow paths connected to the liquid discharge member and having the filters respectively connected to the flow paths, the length of the liquid supply member in the direction in which the discharge ports are disposed can be decreased. Thus, the area of the joined portion between the liquid discharge member and the liquid supply member is reduced so that the good joined state between both the members can be maintained. The area of the filter is ensured so that the sufficient ink supply characteristic can be obtained.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 9A-1 and 9A-2, 9B-1 and 9B-2, and 9C-1 and 9C-2 are cross-sectional views for illustrating a method for filling the liquid discharge head according to the first exemplary embodiment with a liquid.

DESCRIPTION OF THE EMBODIMENTS

Various exemplary embodiments, features, and aspects of the invention will be described in detail below with reference to the drawings.

A basic configuration and a function of a liquid discharge head according to a first exemplary embodiment of the present invention will be described with reference to the figures. An inkjet recording head (hereinafter also referred to as a "recording head") representing a liquid discharge head for discharging a liquid will be described below.

Figure 1:
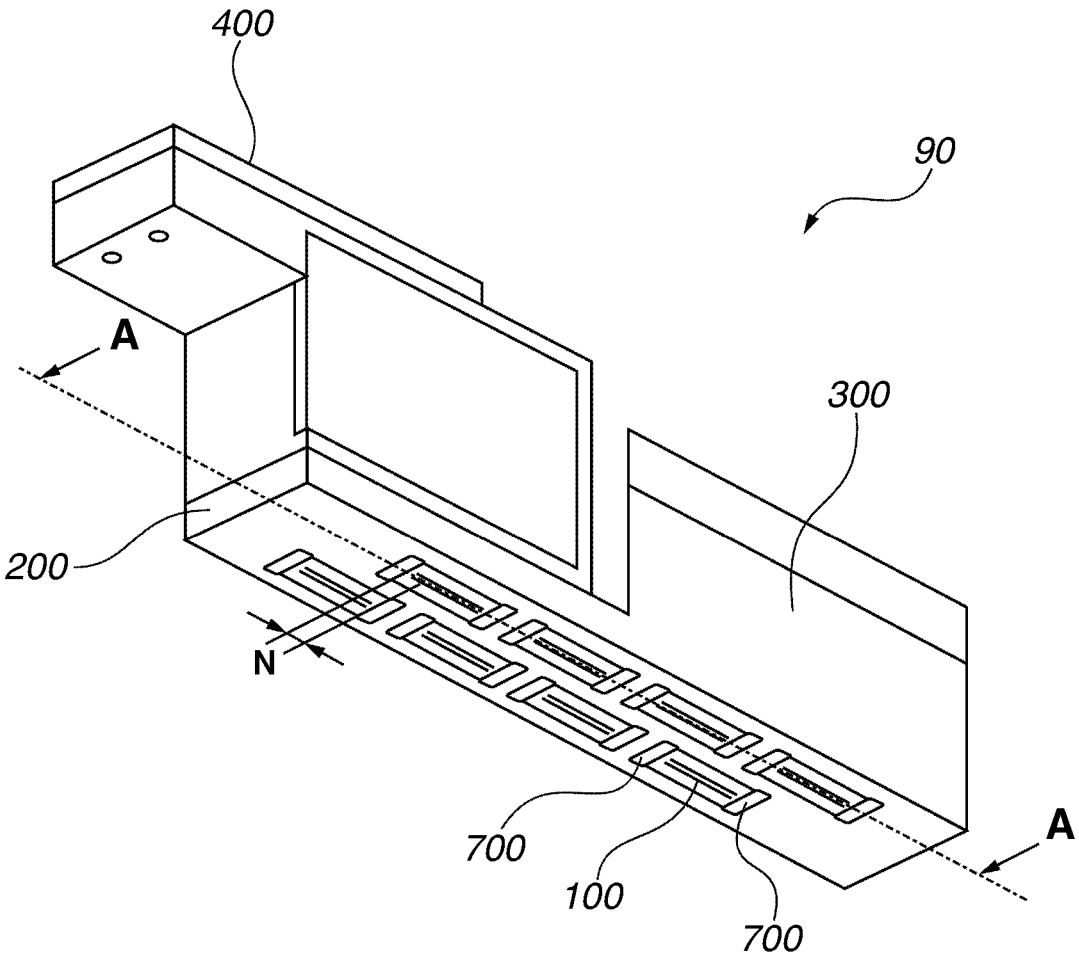
FIG. 1 is a perspective view illustrating a liquid discharge head according to a first exemplary embodiment of the present invention.
Figure 2:
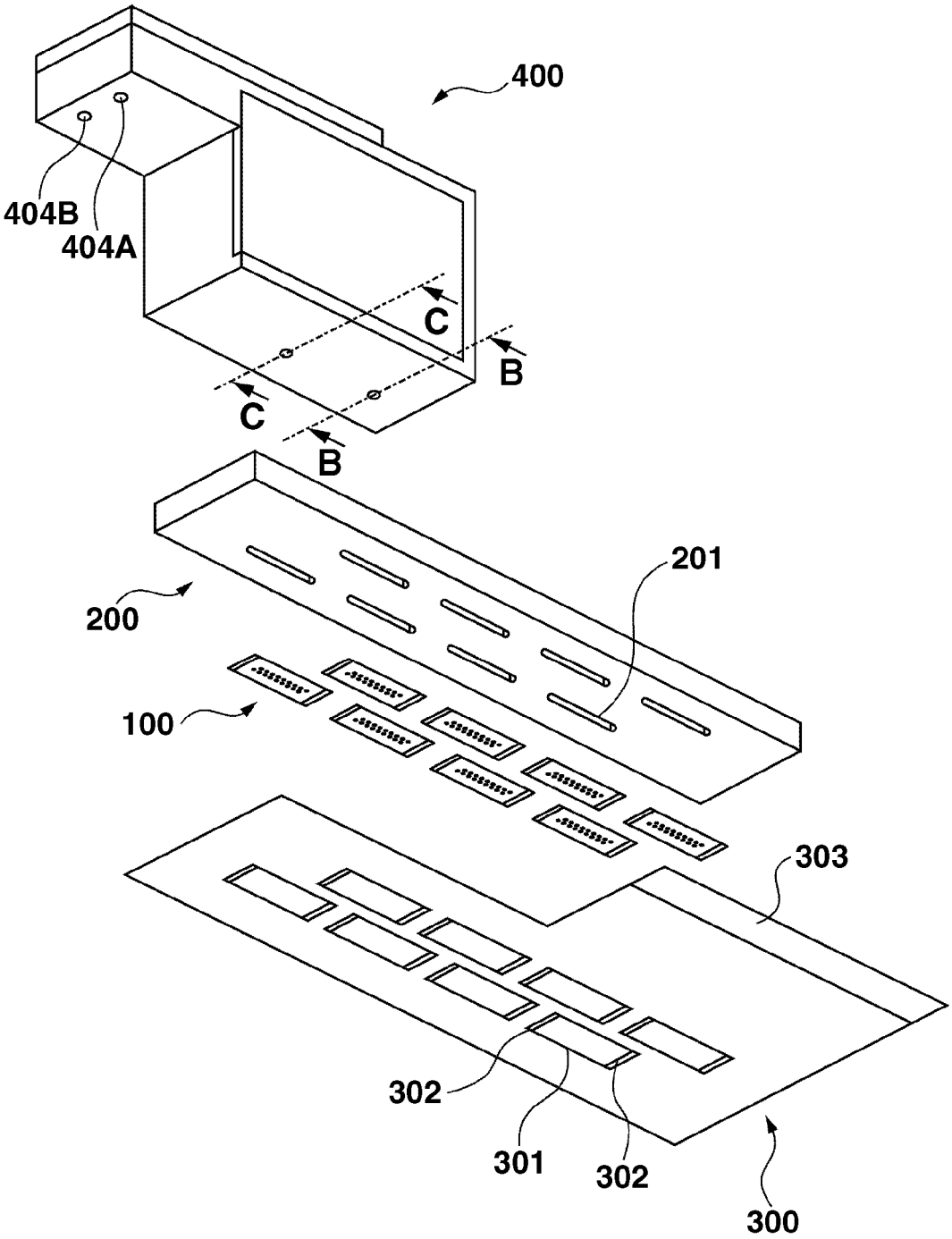
FIG. 2 is an exploded perspective view illustrating the liquid discharge head according to the first exemplary embodiment.
Figure 3A:
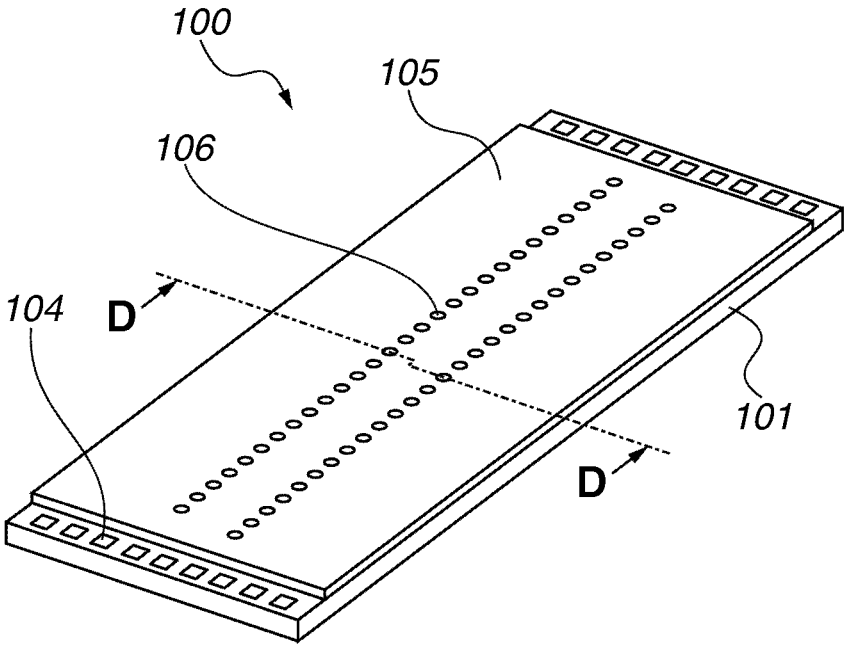
FIG. 3A is 3B are respectively a perspective view and a cross-sectional view for illustrating a configuration of a recording element substrate.
Figure 3B:
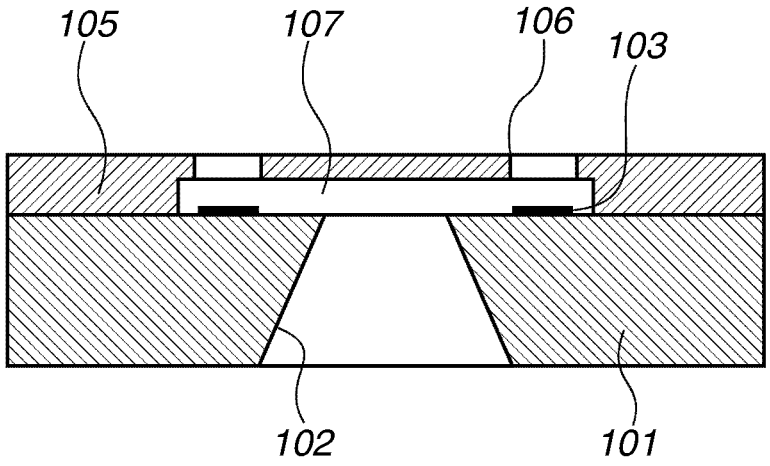
Figure 4:
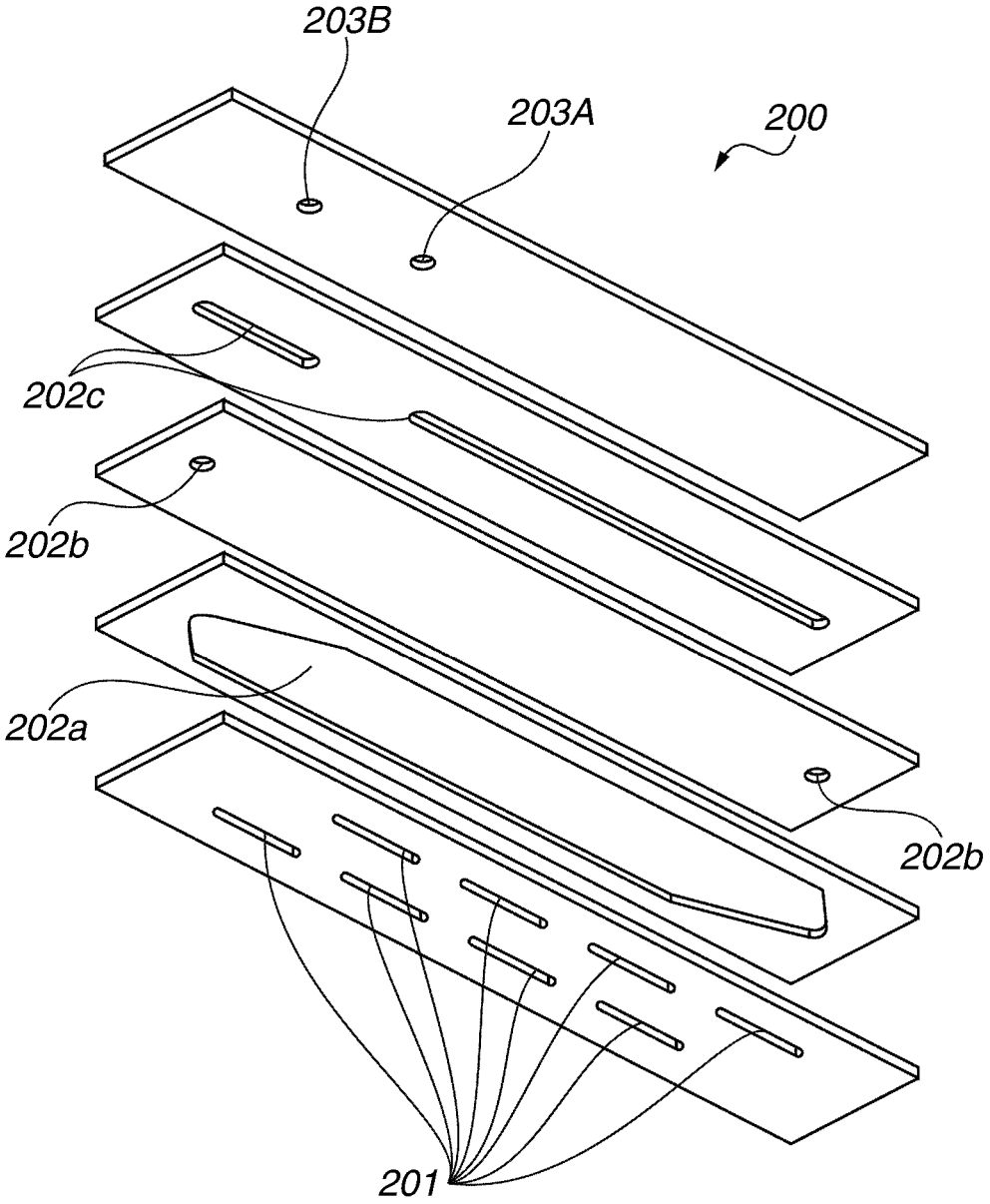
FIG. 4 is an exploded perspective view for illustrating a configuration of a fixing member used for the liquid discharge head according to the first exemplary embodiment.
Figure 5:
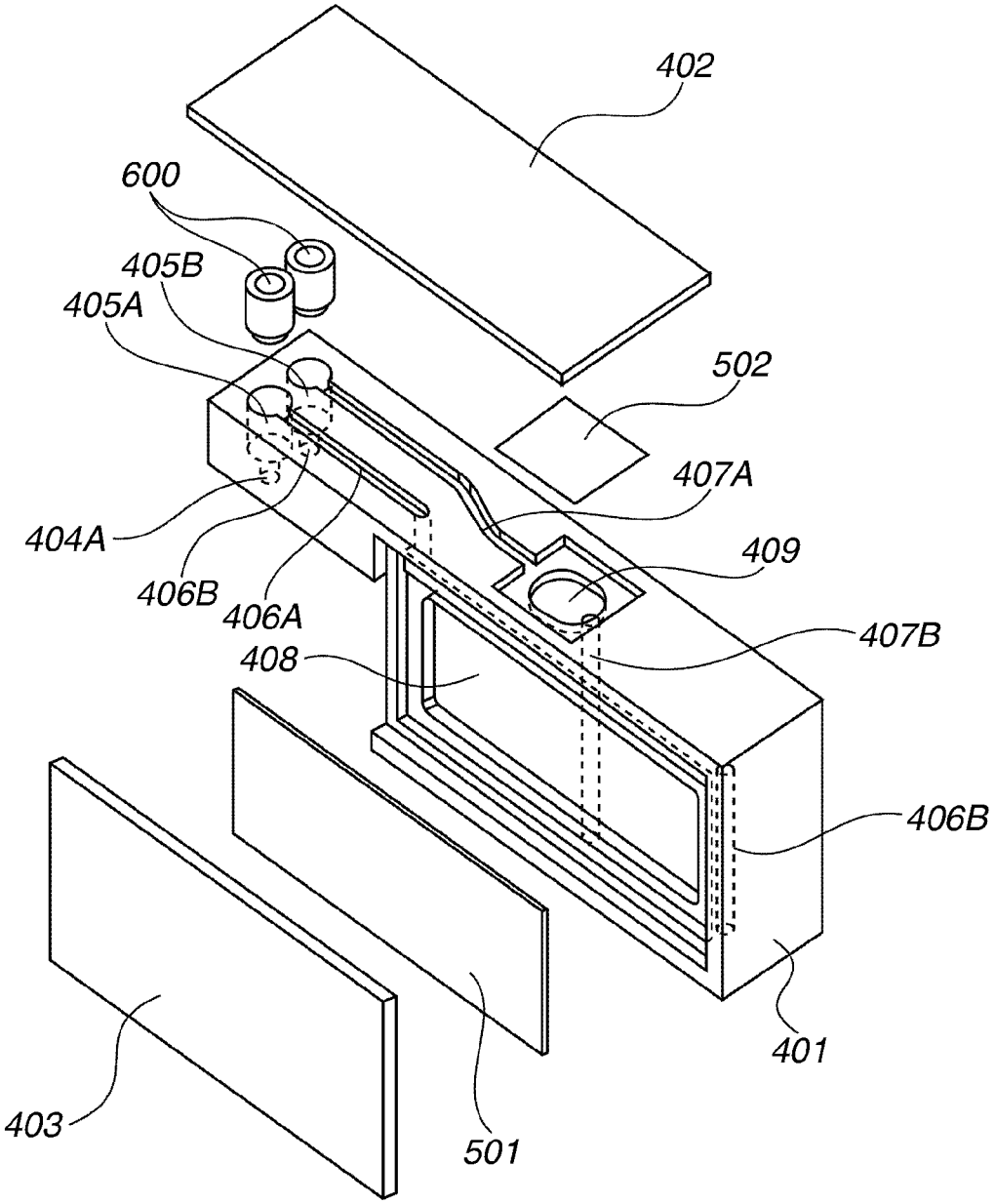
FIG. 5 is an exploded perspective view illustrating a liquid supply member applied to the liquid discharge head according to the first exemplary embodiment.
Figure 6:
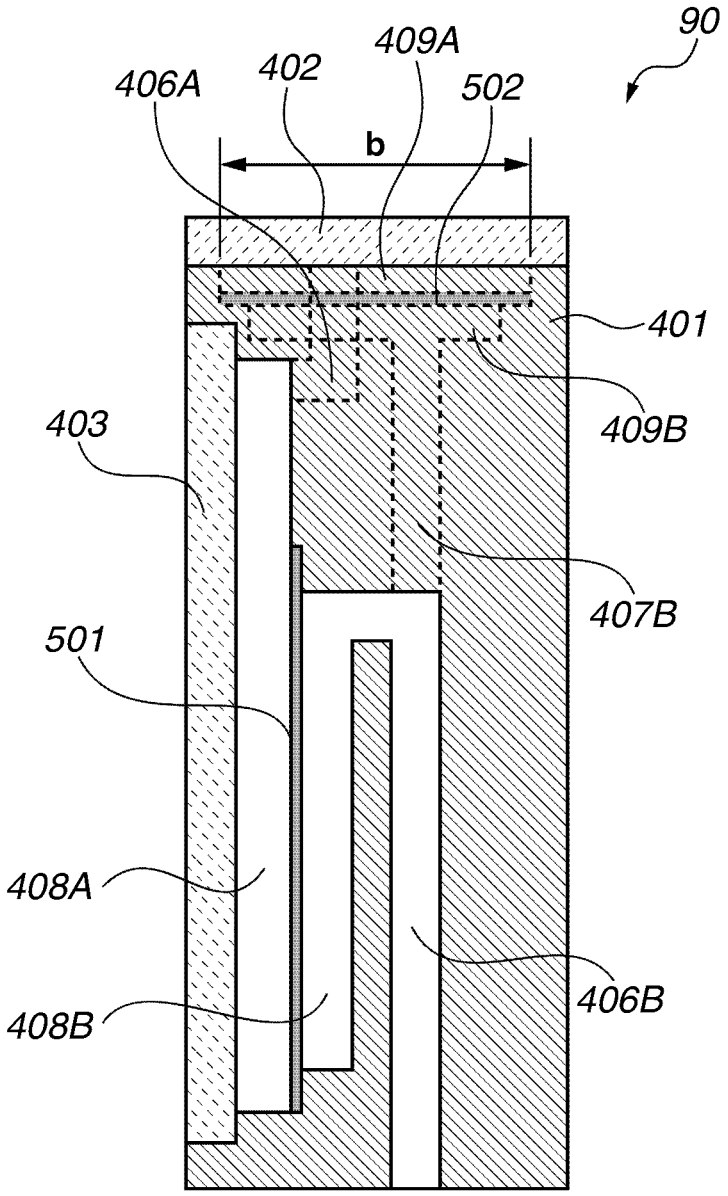
FIG. 6 is a cross-sectional view (a cross section taken along a line B-B illustrated in FIG. 2) illustrating the liquid supply member applied to the liquid discharge head according to the first exemplary embodiment.

A configuration of a recording head 90 according to the first exemplary embodiment will be first described with reference to FIGS. 1 to 6. FIGS. 1 and 2 are respectively a perspective view and an exploded perspective view of the recording head 90. FIGS. 3A and 3B illustrate a configuration of a recording element substrate 100. FIG. 4 illustrates a configuration of a fixing member 200. FIGS. 5 and 6 are respectively an exploded perspective view and a cross-sectional view (a cross-section taken along a line B-B illustrated in FIG. 2) of an ink supply unit 400.

The recording head 90 according to the present exemplary embodiment includes a recording element substrate 100 serving as a liquid discharge substrate, a fixing member 200, an electric wiring member 300, and an ink supply unit 400 serving as a liquid supply member, as illustrated in FIGS. 1 and 2. The recording element substrate 100 and the fixing member 200, to which the recording element substrate 100 is fixed, function as a liquid discharge member.

Eight recording element substrates 100 are arranged on the fixing member 200 in a zigzag shape to have an overlapping area N (see FIG. 1) where they overlap each other in a direction in which a recording medium such as paper is conveyed. The whole recording head 90 has a print width of approximately 6 inches. Further, the recording element substrate 100 is electrically connected to the electric wiring member 300 by a method such as wire bonding, and its part is sealed with and protected by a sealing material 700. The ink supply unit 400 is joined to a surface reverse to a surface, on which the recording element substrates 100 are arranged, of the fixing member 200.

The members constituting the recording head 90 will be described in detail below.

The recording element substrate 100 is a device for discharging ink. FIG. 3A is a perspective view of the recording element substrate 100, and FIG. 3B is a cross-sectional view taken along a line D-D illustrated in FIG. 3A. An ink supply port 102 having a long groove shape is formed on a silicon substrate 101. A plurality of electrothermal transducers 103 serving as an energy generating element for generating energy for discharging ink, and an electric wiring (not illustrated) composed of aluminum connected to the electrothermal transducers 103 are formed on a surface of the silicon substrate 101 by a film forming technique. Electrodes 104, which are electrically connected to the electric wiring member 300, are formed at each of both ends in a longitudinal direction of the recording element substrate 100. Further, a discharge port forming member 105 composed of a resin material is formed on the silicon substrate 101. Discharge ports 106 for discharging ink respectively provided at positions corresponding to the plurality of electrothermal transducers 103 and an ink storage chamber 107 communicating with the discharge ports 106 are formed in the discharge port forming member 105 by a photolithographic technique.

The fixing member 200 is a member for fixing the recording element substrate 100. As illustrated in FIG. 4, the fixing member 200 includes a plurality of layers, and has openings 201 for supplying ink to the recording element substrates 100 formed on its surface, has ink flow paths 202 (202*a* to 202*c*) serving as a third flow path for supplying ink to the openings 201 respectively formed on its inner layers, and has an opening 203A (first opening) and an opening 203B (second opening), which are connected to the ink supply unit 400, described below, formed on its reverse surface. Ink is guided into and out of an area between the ink supply unit 400 and the ink flow path 202 via the two openings 203A and 203B. The length of the fixing member 200 in a direction in which the plurality of discharge ports 106 is disposed is approximately 7 inches.

The electric wiring member 300 is a wiring member for feeding a driving signal and driving power, which are fed from a recording apparatus 1, to the recording element substrates 100. The electric wiring member 300 includes an opening 301 in which the recording element substrate 100 is to be incorporated, electrode terminals 302 each corresponding to the electrodes 104 in the recording element substrate 100, and an external signal input terminal 303 for receiving the driving signal and the driving power from the recording apparatus 1.

The ink supply unit 400 is a member connected to the recording apparatus 1 for supplying ink to the recording element substrates 100 via the fixing member 200. As illustrated in FIG. 5, the ink supply unit 400 includes a filter containing member 401 serving as a casing, a first plate 402, a second plate 403, a first filter 501, a second filter 502, and joint rubbers 600. The filter containing member 401, the first plate 402, and the second plate 403 are formed of a resin material. The first filter 501 and the second filter 502 are thermally welded, respectively, to walls of a first containing chamber 408 and a second containing chamber 409. The joint rubber 600 is press-fitted to joint rubber containing chambers 405A and 405B. The first plate 402 and the second plate 403 are joined to the filter containing member 401 by adhesion or ultrasonic welding. Ink joint pipes provided in the recording apparatus 1 are respectively inserted into the joint rubbers 600 via openings 404A and 404B. Ink stored in an ink tank 2 serving as a liquid storage chamber in the recording apparatus 1 is guided into and out of the ink supply unit 400.

The recording apparatus 1, in which the recording head 90 according to the present exemplary embodiment is loaded, will be described below.

Figure 7:
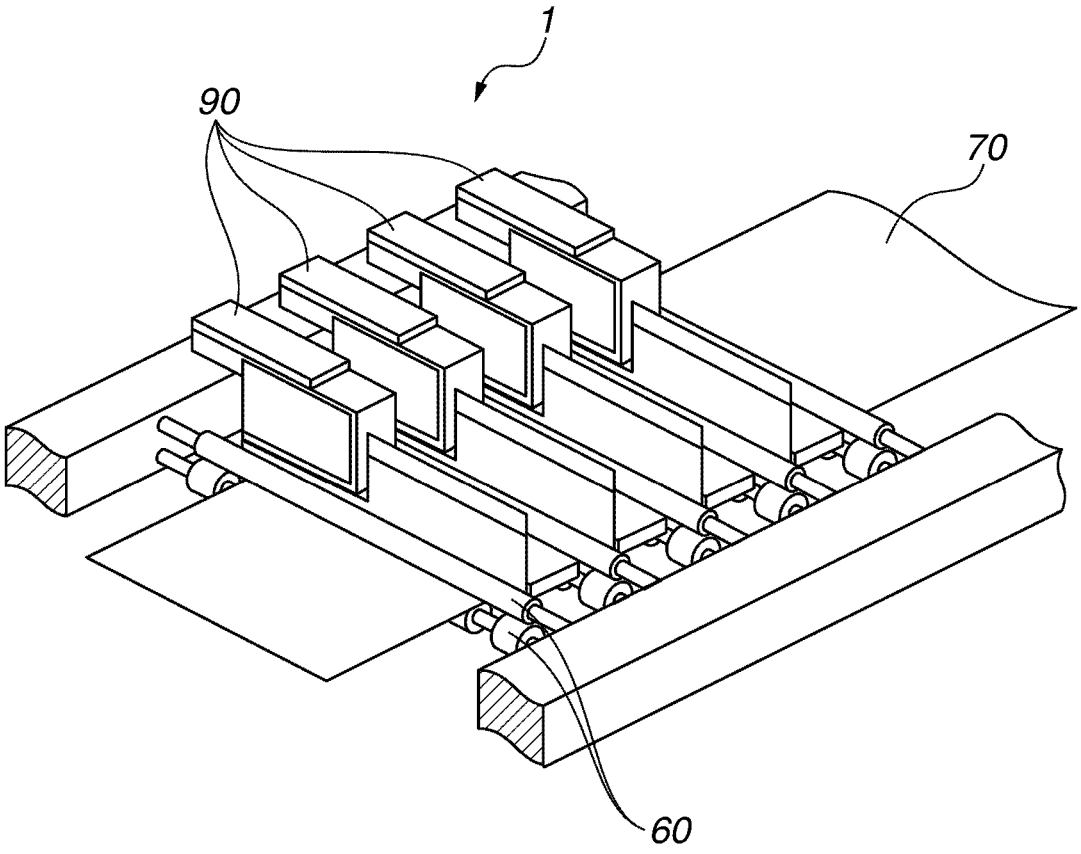
FIG. 7 is a perspective view illustrating a print head in a liquid discharge apparatus having the liquid discharge head according to the first exemplary embodiment mounted thereon.

FIG. 7 is a schematic view of a part of the recording apparatus 1 having the recording head 90 loaded therein, illustrating how recording is being performed. Four recording heads 90 corresponding to inks in four colors, i.e., black (Bk), cyan (C), magenta (M), and yellow (Y), for example, are loaded into the recording apparatus 1. A paper conveying roller 60 is arranged between the recording heads 90. The paper conveying rollers 60 convey recording paper 70. The electrothermal transducers 103 are driven so that the ink is discharged from the recording head 90 in response to a driving signal fed to the recording head 90 from a central processing unit (CPU) 12 serving as a control unit provided in the recording apparatus 1. Therefore, recording is performed on the recording paper 70.

Figure 17:
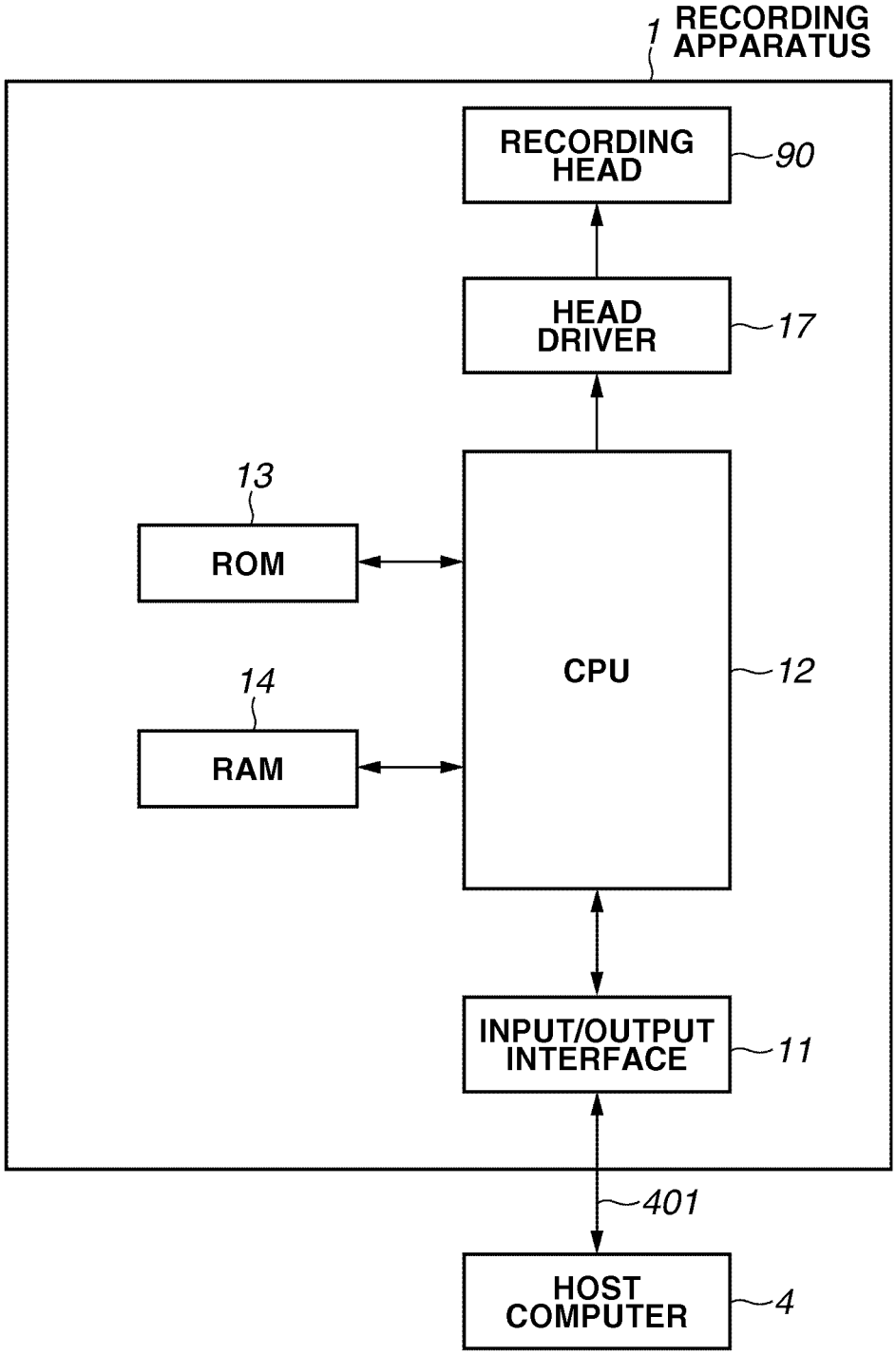
FIG. 17 is a block diagram illustrating a schematic configuration of a control system in the recording apparatus according to the present invention.

FIG. 17 illustrates a schematic configuration of a control system in the recording apparatus 1 in the present exemplary embodiment. Control of a head for ink discharge will be described with reference to FIG. 17.

The recording apparatus 1 receives recording information relating to an image to be recorded from a host computer 4. The recording information received in the recording apparatus 1 is temporarily stored in an input/output interface 11 provided in the recording apparatus 1 while being converted into data that can be processed in the recording apparatus 1. The data is input to the CPU 12, which is also used as a feeding unit of a recording head driving signal. The CPU 12 processes the data input to the CPU 12 using a peripheral unit such as a random access memory (RAM) 14 based on a control program stored in a read-only memory (ROM) 13, and converts the processed data into binarization data (recoding data) indicating whether an ink dot is to be formed on recording paper. The above-mentioned recording data and recording head driving data output from the CPU 12 are input to a head driver 17 for driving the electrothermal transducers 103 provided in the recording head 90. The electrothermal transducers 103 are driven in response to both of the data to discharge ink.

Figure 16:
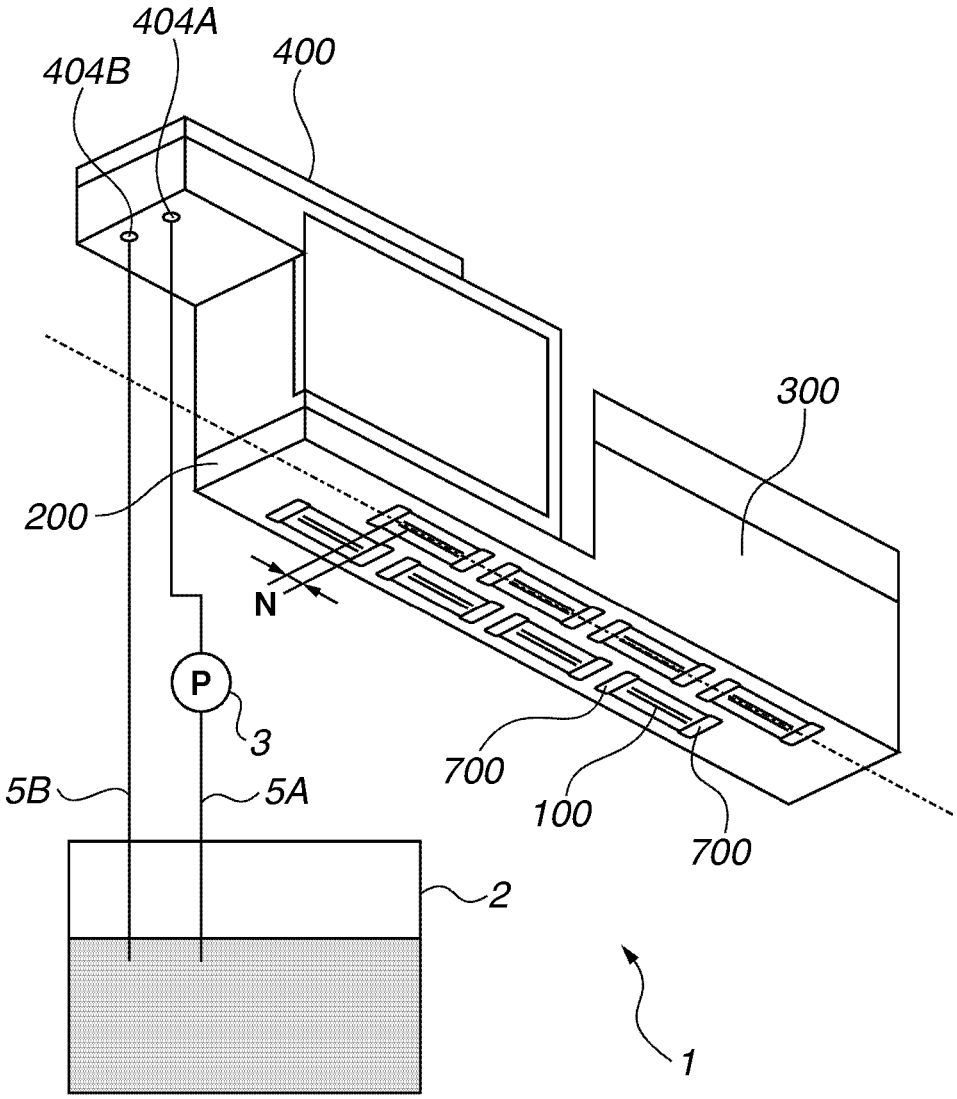
FIG. 16 is a perspective view for illustrating an ink supply unit in a recording apparatus having a recording head according to the present invention mounted thereon.

In the present exemplary embodiment, ink can be circulated for the recording head 90. Therefore, the recording apparatus 1 includes the ink tank 2 that stores ink to be supplied to the recording head 90, and a pump 3 serving as a circulation unit for circulating the ink provided halfway in a flow path between the ink tank 2 and the recording head 90, as illustrated in FIG. 16. In the recording apparatus 1 having the recording head 90 according to the present exemplary embodiment loaded therein, the pump 3 for circulating ink may be provided in at least one of two ink flow paths 5A and 5B provided between the ink tank 2 and the recording head 90.

Characteristics of the ink supply unit 400 used for the recording head 90 will be described in detail with reference to FIG. 8.

The ink supply unit 400 includes the recording element substrate 100, and an ink flow path 406 and an ink flow path 407 that communicate with each other so that ink can be circulated via the ink tank 2 provided in the recording apparatus 1. The ink flow path 406 (406A, 406B) is a flow path for guiding ink introduced into the ink tank 2 to the fixing member 200 when the recording apparatus 1 performs a recording operation. The ink flow path 407 (407A, 407B) is a flow path for guiding ink introduced from the fixing member 200 to the ink tank 2 during the recording operation. During the recording operation, ink flows in a direction indicated by an arrow B.

A first filter 501 and a second filter 502 for preventing dust from entering the recording head 90 are respectively provided halfway in the flow paths 406 and 407, and are respectively disposed in the first containing chamber 408 and the second containing chamber 409. As illustrated in FIG. 6, outer surfaces of the filters 501 and 502 each having a plurality of openings, through which a liquid passes, respectively partition filter containing chambers 408 and 409 into first containing chambers 408A and 408B and second containing chambers 409A and 409B. The ink flow path 406B (first flow path) provided in the ink supply unit 400 connects an opening 203A of the fixing member 200 and the first containing chamber 408B. The ink flow path 407B (second flow path) connects an opening 203B of the fixing member 200 and the second containing chamber 409B.

The first containing chamber 408A upstream of the first filter 501 is arranged higher in a vertically upward direction than the first filter 501 during the recording operation. In such a configuration, a possibility is decreased that the effective area of the filter, i.e., the area of the filter through which ink passes at the time of its use can be reduced because bubbles move upward by buoyancy even when they are carried into the filter during the recording operation.

The ink supply unit 400 is suitably configured for a case where ink is circulated during the recording operation to cool the recording head 90 in order to suppress a temperature rise in the recording head 90. During the recording operation, ink passes through the first filter 501 in the ink supply unit 400 from the ink tank 2 in the recording apparatus 1, flows through the ink flow path 202 formed in the fixing member 200, passes through the second filter 502, and returns to the ink tank 2 in the recording apparatus 1.

Therefore, the first filter 501 disposed on the side guiding ink into the recording element substrate 100 during the recording operation requires a large area to reduce its pressure loss caused by ink flow during the recording operation. If the filter has a high pressure loss, an effect on the recording operation, for example, defective ink supply to the recording element substrate 100 may occur. If an ink flow rate required to cool the recording head 90 is approximately 50 to 200 cc/min, for example, the area of the first filter 501 is set to approximately 1000 to 4000 $mm^2$ to prevent the effect of the pressure loss of the filter on the recording operation. The filtering accuracy of the first filter 501 used in this case is 5 μm. As illustrated in FIG. 8, length a of the first filter 501 in a direction in which the plurality of discharge ports 106 is disposed is smaller than the length of the fixing member 200 in the direction of disposition.

On the other hand, a pressure loss of the second filter 502 disposed on the side guiding ink out of the recording element substrate 100 during the recording operation does not affect the recording operation. Therefore, the area of the second filter 502 can be reduced. An amount of ink used for recording, which passes through the second filter 502 is smaller than an amount of ink that passes through the first filer 501. Therefore, the second filter 502 may be smaller than the first filter 501. In order to enable reduction of the capability of the pump 3, the area of the filter may be reduced to decrease the pressure loss thereof. However, in order to remove bubbles in the recording head 90, the area of the filter should be reduced to increase an ink flow velocity. From both viewpoints, a filter having filtering accuracy similar to that of the first filter 501 is used, and the area of the second filter 502 is set to approximately 50 to 200 $mm^2$.

An arrangement of filters and ink flow paths in the present exemplary embodiment will be described below.

Figure 8:
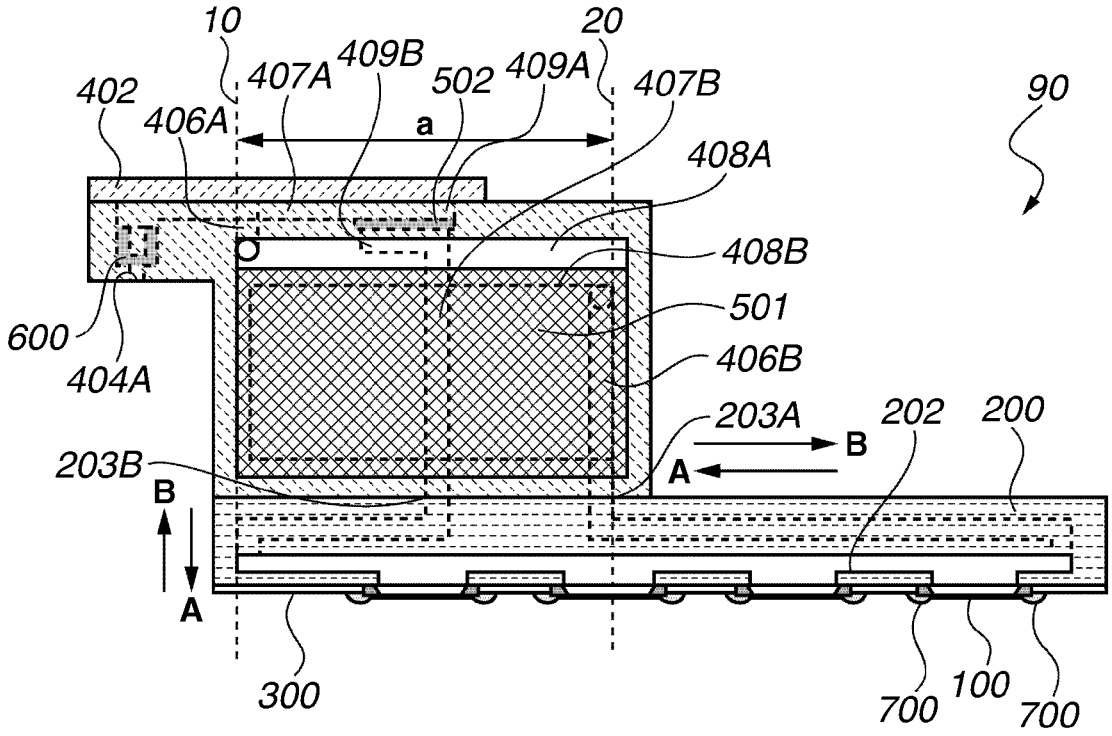
FIG. 8 is a cross-sectional view (a cross section taken along a line A-A illustrated in FIG. 1) illustrating the liquid discharge head according to the first exemplary embodiment.

In the present exemplary embodiment, the first filter 501 having a larger area is disposed so that its outer surface is in a direction of gravity at the time of using the recording head 90 and in a direction in which the plurality of discharge ports 106 is disposed (substantially parallel to the direction of gravity), as illustrated in FIG. 8. The second filter 502 having a relatively small area is disposed on an upper surface of the filter containing member 401 so that its outer surface crosses the direction of gravity (substantially perpendicular to the direction of gravity), as illustrated in FIG. 6. The direction of gravity at the time of using the recording head 90 is a downward direction illustrated in FIG. 8.

The first filter 501, the second filter 502, the ink flow path 406B, and the ink flow path 407B have the following relationship. A first surface 10 is perpendicular to the direction in which the discharge ports 106 are disposed and parallel to the direction of gravity and goes through one end of the length of the first filter 501 in the direction of disposition. A second surface 20 is parallel to the first surface 10 and goes through the other end of the length of the first filter 501 in the direction of disposition. The second filter 502, the ink flow path 406B, and the ink flow path 407B are disposed in an area between the first surface 10 and the second surface 20 (see FIG. 8). More specifically, the second filter 502, the ink flow path 406B, and the ink flow path 407B are disposed in a range of the length a of the first filter 501 which is smaller than the length of the fixing member 200.

Further, the first filter 501 is disposed to fall within length b of the second filter 502 in a width direction of the filter containing member 401, as viewed from the outer surface of the second filter 502 (see FIG. 6).

Therefore, the ink supply unit 400 in the present exemplary embodiment includes two filters for ink circulation. Therefore, even if an area of a filter increases as the ink flow rate increases, the ink supply unit 400 can be miniaturized, and thus the recording head 90 can also be miniaturized.

Particularly, the first filter 501 having a larger area is disposed in the direction of gravity and in the direction in which the plurality of discharge ports 106 is disposed. Further, the first filter 501 is disposed to fall within the length b of the outer surface of the second filter 502, as viewed from the outer surface of the second filter 502. These configurations enable decrease of the length in the width direction of the recording head 90. When the length in the width direction of the recording head 90 is decreased, in the recording apparatus 1 in which the plurality of recording heads 90 is disposed side by side in the width direction to correspond to a plurality of colors, the recording heads 90 can be narrowly spaced. Thus, the recording apparatus 1 can also be miniaturized. Further, an area where recording paper is kept parallel to the recording head 90 can be narrowed. This enables improvement in conveyance accuracy of recording paper, prevention of a paper jam, and finally high-quality recording.

The fixing member 200 is formed of a material having a linear expansion coefficient closer to that of the silicon substrate 101, for example, alumina. On the other hand, the ink supply unit 400 is formed of resin. Therefore, the linear expansion coefficient of the fixing member 200 and the linear expansion coefficient of the ink supply unit 400 differ from each other. This difference generates a stress in a joined portion between the fixing member 200 and the ink supply unit 400. The joined portion may be deformed by the stress. The larger the area of the joined portion between both the members, the greater this problem becomes.

In the present exemplary embodiment, the first filter 501 having a larger area is disposed in the direction of gravity and in the direction in which the plurality of discharge ports 106 is disposed. The second filter 502, the ink flow path 406B, and the ink flow path 407B are disposed in a range of the length a of the first filter 501, which is smaller than that of the fixing member 200, as described above. Thus, the length of the ink supply unit 400 in the direction in which the plurality of discharge ports 106 is disposed can be decreased. Therefore, the length of the joined portion between the fixing member 200 and the ink supply unit 400 in the direction of disposition can be decreased. Owing to the filter arrangement and the flow path arrangement, a possibility that the joined portion between the fixing member 200 and the ink supply unit 400 is deformed by the difference in the linear expansion coefficients can be reduced, so that a good joined state between the fixing member 200 and the ink supply unit 400 can be maintained. Even if the length of the ink supply unit 400 in the direction of disposition is decreased to maintain the good joint state between both of the members, the area of the first filter 501 is ensured so that a sufficient ink supply characteristic can be obtained.

It is further desirable that the length of the ink supply unit 400 in the direction in which the discharge ports 106 are disposed is in a range of one-fourth to one-second the length of the fixing member 200 in the direction of disposition.

In the present exemplary embodiment, a surface of the ink supply unit 400, on which openings of the ink flow path 406B and the ink flow path 407B are disposed, is joined to the fixing member 200, as illustrated in FIG. 8. The fixing member 200 and the ink supply unit 400 may be joined to each other in an area between the first surface 10 and the second surface 20, i.e., in at least a part of the range of the length a of the first filter 501.

Considering the above-mentioned problem, the second filter 502 may be disposed so that the length of the ink supply unit 400 in the direction in which the discharge ports 106 are disposed is not increased. More specifically, the second filter 502 may be disposed so that its surface is in the direction of gravity.

Further, there is an area to which the ink supply unit 400 is not joined on an upper surface of the fixing member 200. Therefore, a member for electrically connecting to the recording apparatus 1 can be disposed in the area. In this case, when a plurality of recording heads 90 is provided, the electric connection member need not be disposed between the plurality of recording heads 90. Therefore, the electric connection member does not restrict a distance between the recording heads 90.

A method for filling the recording head 90 including the ink supply unit 400 in the present exemplary embodiment with ink (a liquid filling method) will be described below.

When the recording head 90 is filled with ink, bubbles may accumulate between the two filters, which may reduce the effective area of the filter. However, the accumulating bubbles are difficult to remove.

The present exemplary embodiment is directed to an ink filling method for suppressing generation of bubbles and a bubble pool in an ink flow path sandwiched between the first filter 501 and the second filter 502 (i.e., a flow path for supplying ink to the recording element substrate 100). First, a first step of guiding ink into the recording element substrate 100 from the second filter 502 side in the ink supply unit 400 is performed to circulate the ink. Then, a second step of circulating ink through the recording element substrate 100 from the first filter 501 side is performed. The method will be specifically described below.

Figure 18:
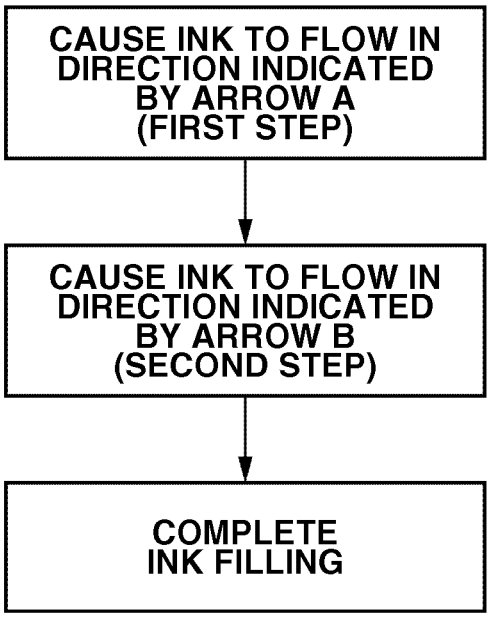
FIG. 18 is a flowchart illustrating a method for filling the liquid discharge head according to the first exemplary embodiment with a liquid.

FIG. 9 illustrates a behavior of ink 80 and bubbles 81 in the ink supply unit 400 when the recording head 90 is filled with the ink 80. FIGS. 9A-1, 9B-1, and 9C-1 illustrate an upper portion of a cross section taken along a line C-C illustrated in FIG. 2, and FIGS. 9A-2, 9B-2, and 9C-2 illustrate a cross-section taken along the line B-B of the ink supply unit 400 illustrated in FIG. 2. FIGS. 9A-1 and 9A-2 illustrate how the first step ends, FIGS. 9B-1 and 9B-2 illustrate how the second step is being performed, and FIGS. 9C-1 and 9C-2 illustrate a state after the second step has ended. An arrow illustrated in FIG. 9 indicates a direction in which the ink 80 flows, and corresponds to an arrow A illustrated in FIG. 8. FIG. 18 is a flowchart for illustrating steps of filling the recording head 90 according to the present exemplary embodiment with ink. Besides, even when a meniscus is formed at a position different from the figure depending on the size of the filter, the length and the shape of the filter containing chamber, and the diameter of the ink flow path, an essential behavior does not change.

In the first step, the ink 80 flows in the direction indicated by the arrow A illustrated in FIG. 8. The ink 80 guided out of the ink tank 2 flows through the ink flow path 407A, the second containing chamber 409A, the second filter 502, the second containing chamber 409B, and the ink flow path 407B in this order, and is guided into the ink flow path 202 in the fixing member 200. In the first step, the ink 80 guided out of the ink flow path 202 returns to the ink tank 2 after passing through the ink flow path 406B, the first containing chamber 408B, the first filter 501, the first containing chamber 408A, and the ink flow path 406A in this order.

At this time, the ink 80, which is to pass through the second filter 502, passes through only a part of the second filter 502. The ink 80 may pass through only a portion of the second filter 502, closest to the ink flow path 407A on the side of guiding into the ink tank 2 depending on the length and the shape of the second containing chamber 409A and the flow velocity of the ink 80. Alternatively, the ink 80 may move along an outer wall of the first containing chamber 409A and pass through the outer periphery of the second filter 502. In either case, the bubbles 81 remain in both the second containing chambers 409A and 409B, as illustrated in FIG. 9A-1.

Figures 1, 9A:
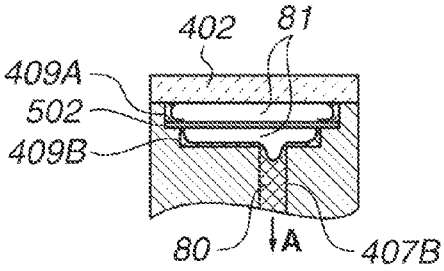

The ink 80 accumulates at the bottom of the first containing chamber 408B positioned on the upstream side in ink flow, and passes through the bottom of the first filter 501 by breaking the meniscus when its pressure exceeds a predetermined pressure, as illustrated in FIG. 9A-2. The first containing chamber 408A positioned on the downstream side in ink flow is filled with the ink 80, which has passed through the first filter 501, so that its liquid surface rises. Therefore, air existing in the first containing chamber 408A before the first step is performed is carried into the ink tank 2. Therefore, at this time point, the bubbles 81 remain in the first containing chamber 408B.

Then, as the second step, the ink 80 flows in a direction indicated by the arrow B illustrated in FIG. 8 by reversing ink flow. The ink 80 guided out of the ink tank 2 flows through the ink flow path 406A, the first containing chamber 408A, the first filter 501, the first containing chamber 408B, and the ink flow path 406B in this order, and is guided into the ink flow path 202 in the fixing member 200. In the second step, the ink 80 guided out of the ink flow path 202 returns to the ink tank 2 after passing through the ink flow path 407B, the second containing chamber 409B, the second filter 502, the second containing chamber 409A, and the ink flow path 407A in this order.

Figures 1, 9B:
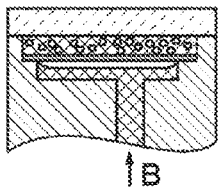
Figures 1, 9C:
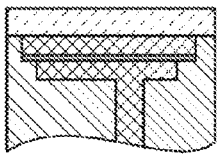
Figures 2, 9A:
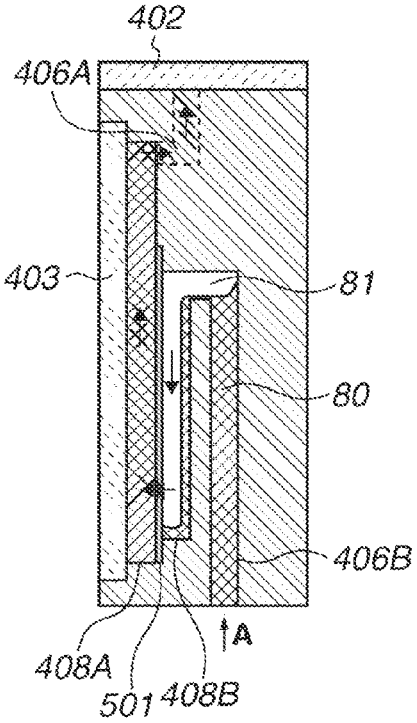
Figures 2, 9B:
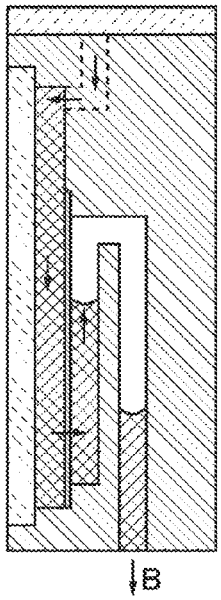
Figures 2, 9C:
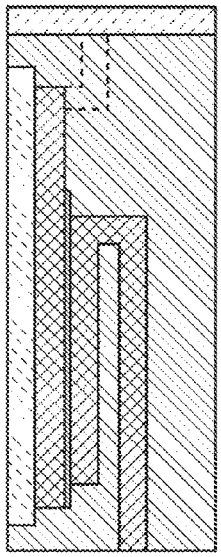

At this time, when the ink 80 passes through the first filter 501, the bubbles 81 move as a liquid surface of the first containing chamber 408B rises, and the first containing chamber 408B is filled with the ink 80, as illustrated in FIG. 9B-2. The bubbles 81 in the first containing chamber 408B pass through the ink flow path 202 in the fixing member 200, and moves to the second containing chamber 409B. A liquid surface of the second containing chamber 409B rises, and the second containing chamber 409B is filled with the ink 80. The bubbles 81 pass through the second filter 502 by buoyancy, and are carried into the ink tank 2. At this time, the smaller the area of the second filter 502, at the lower flow rate the ink 80 required for the bubbles 81 can be passed. However, a pressure loss during ink circulation increases. Therefore, the most suitable filter area and ink flow rate may be set, as needed, depending on the performance of the pump 3 for circulating the ink 80. In this manner, the first containing chambers 408A and 408B, the second containing chambers 409A and 409B, and the ink flow paths are filled with the ink 80, as illustrated in FIGS. 9C-1 and 9C-2.

Even when the ink 80 is first circulated on the side of the first filter 501 in consideration of an ink filling characteristic in the recording apparatus 1, a similar effect is obtained by circulating and guiding the ink 80 into the recording element substrate 100 on the side of the second filter 502, according to the present exemplary embodiment, after the ink filling, and then circulating and guiding the ink 80 into the recording element substrate 100 on the side of the first filter 501.

Thus, in the ink supply unit 400 having a configuration in which one of the filters is disposed in the direction of gravity when the recording head 90 is used and the other filter is disposed in a direction crossing the direction of gravity, the ink 80 flows as described above. Thus, the bubbles 81 in the containing chamber are moved to the ink tank 2 using buoyancy, and thus can be easily removed. Therefore, a reduction of the effective area of the filter can be suppressed.

On the other hand, when both the two filters are disposed in the direction of gravity when the recording head 90 is used, the bubbles 81 that accumulate between the two filters are difficult to remove even if the ink 80 in the flow path is circulated in a direction opposite to that during the recording operation, according to the present exemplary embodiment. If the ink 80 flows with nothing left in the ink flow path, the ink 80 passes through only the bottom of the filter when the filter is disposed in the direction of gravity, as illustrated in FIG. 9A-2. Thus, the bubbles 81 remain in the containing chamber upstream of the filter. In a configuration in which both the two filters are disposed in a vertical direction, therefore, the bubbles 81 only move back and forth between the filters even if the ink 80 is caused to flow in a different direction. Therefore, the effective area of the filter may be reduced.

The configuration of the ink supply unit 400 in the present exemplary embodiment is not limited to the shape of the ink supply unit 400, the shape of the filter, the shape of the containing chamber, and the shape of the ink flow path, as described above with reference to FIG. 8. The configuration of the ink supply unit 400 may be optionally determined according to the specification of the recording head 90.

Figure 10:
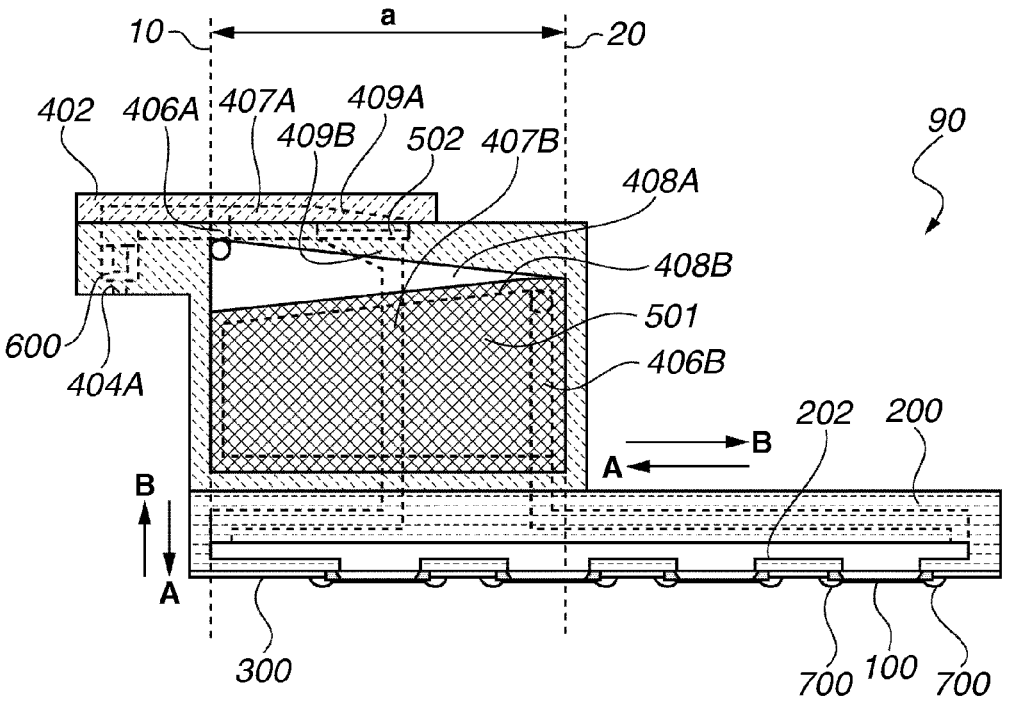
FIG. 10 is a cross-sectional view (a cross section taken along a line A-A illustrated in FIG. 1) illustrating another form of the liquid discharge head according to the first exemplary embodiment of the present invention.

The first containing chamber 408 and the second containing chamber 409 may respectively have wall surfaces having inclinations in the direction of gravity so that bubbles in the containing chambers are easily discharged by ink flow, as illustrated in FIG. 10, for example. In this case, the wall surfaces may particularly preferably be inclined so that the bubbles are easily moved in an ink flow direction (indicated by an arrow B) in the second step of moving the bubbles to the ink tank 2.

The ink flow paths 406A and 407A may be formed in the first plate 402 or in both the filter containing member 401 and the first plate 402.

Figure 11:
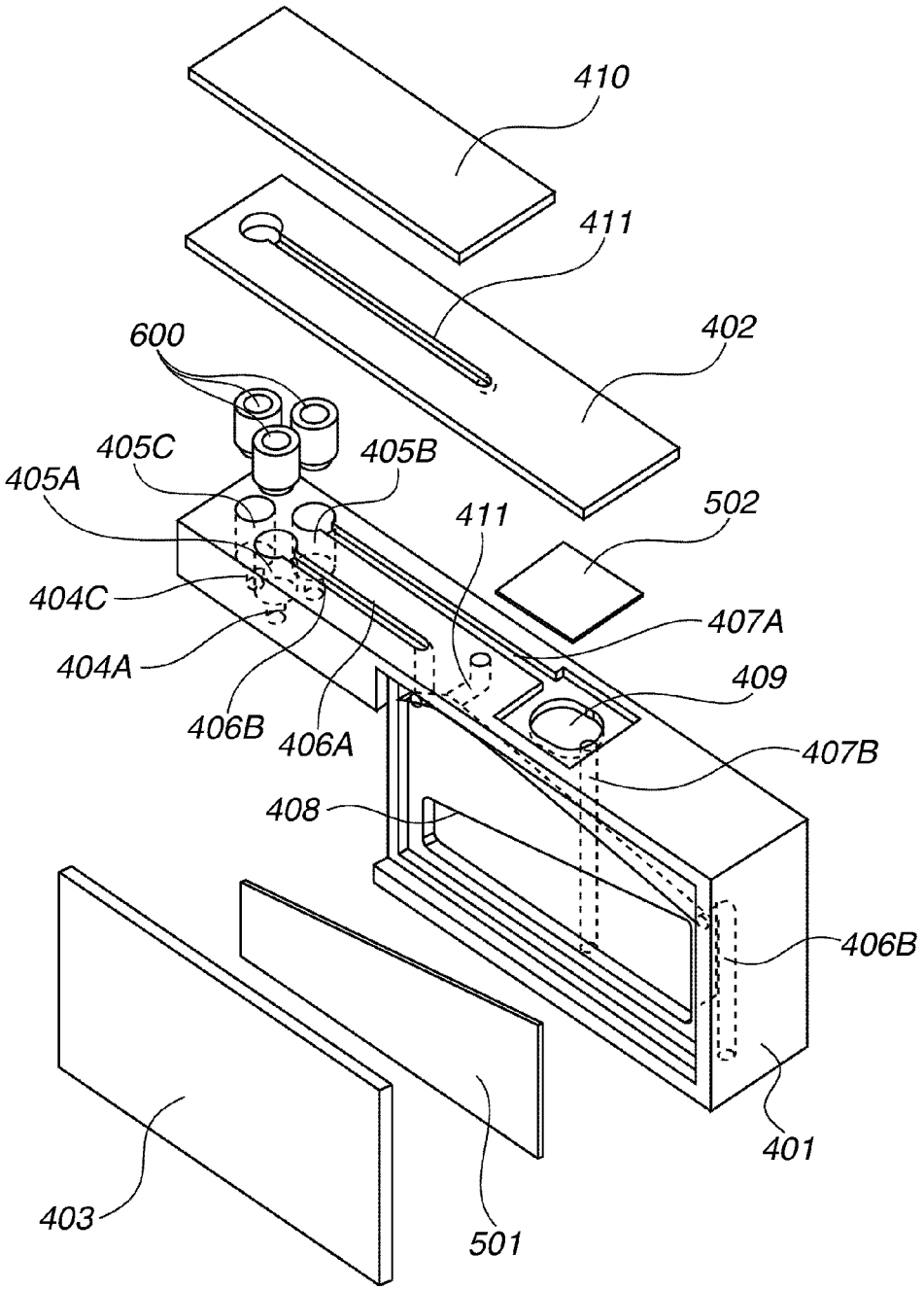
FIG. 11 is an exploded perspective view illustrating a liquid discharge head according to a second exemplary embodiment of the present invention.
Figure 12:
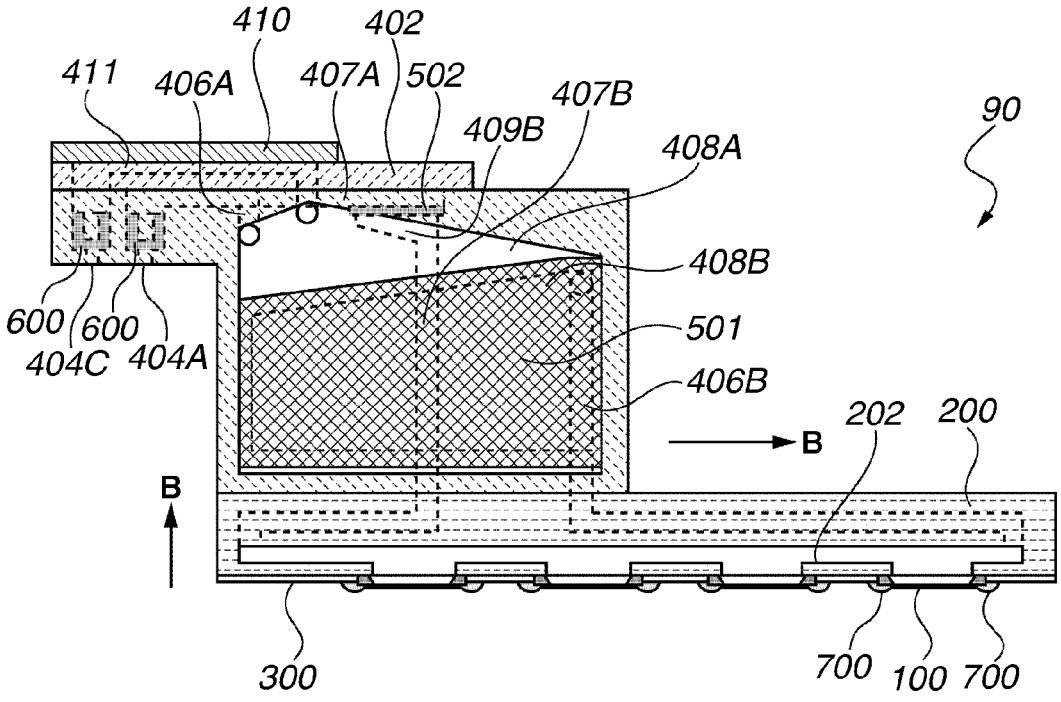
FIG. 12 is a cross-sectional view (a cross section taken along a line A-A illustrated in FIG. 1) illustrating the liquid discharge head according to the second exemplary embodiment of the present invention.
Figure 19:
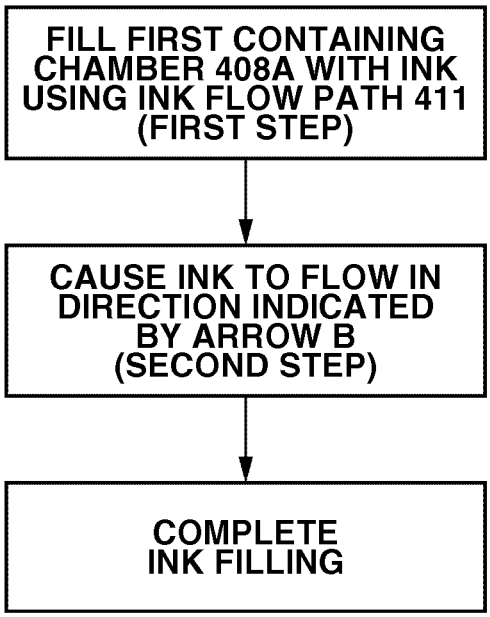
FIG. 19 is a flowchart illustrating a method for filling the liquid discharge head according to the second exemplary embodiment with a liquid.

FIGS. 11 and 12 illustrate a configuration including an ink flow path 411 (fifth flow path) communicating with a first containing chamber 408A in addition to the configuration described in the first exemplary embodiment as a second exemplary embodiment. FIG. 19 is a flowchart illustrating steps of filling a recording head 90 according to the present exemplary embodiment with ink. The ink flow path 411 is mainly used when the recording head 90 is filled with ink. The present exemplary embodiment differs from the first exemplary embodiment in an ink filling method. The ink filling method will be described.

A part of the ink flow path 411 is formed in a filter containing member 401, and the other part thereof is formed of a first plate 402 and a third plate 410 formed of a resin material. A groove serving as a part of the ink flow path 411 is formed on an upper surface of the first plate 402. The first plate 402 and the third plate 410 are joined to each other by adhesion or welding so that a part of the ink flow path 411 is formed. The ink flow path 411 is connected to an ink joint pipe, which has been inserted into a joint rubber 600 in a joint rubber containing chamber 405C, in a recording apparatus 1, to communicate with an ink tank 2 in the recording apparatus 1, similarly to ink flow paths 406 and 407.

As illustrated in FIG. 12, a connection portion between the ink flow path 411 and the first containing chamber 408A is provided at a position higher than a connection portion between a first ink flow path 406A and the first containing chamber 408A and a connection portion between an ink flow path 406B and a first containing chamber 408B. An ink filling characteristic can be further improved by providing the ink flow path 411. Details will be described below.

In order to moisturize discharge ports 106 in a recording element substrate 100 during physical distribution, for example, physical distribution ink may be stored in the recording head 90, and the recording head 90 may be filled with recording ink after it is brought into an empty state by discharging the physical distribution ink when mounted on the recording apparatus 1. At this time, a surface of a filter is wet with the physical distribution ink. When the ink filling method described in the first exemplary embodiment is applied in this state, air and ink are mixed to pass through the filter so that very small bubbles are generated in large amounts downstream of the filter in an ink flow direction. The very small bubbles may adhere to a wall surface of an ink flow path 202 in a fixing member 200 depending on the shape of the ink flow path 202 and its surface texture. In this case, in order to remove the very small bubbles, recording ink having a high flow rate continues to flow for a long time when the recording head 90 is filled with the ink. When the very small bubbles remain in the ink flow path 202, the very small bubbles move to the discharge ports 106 during a recording operation. The ink cannot be discharged from the desired discharge port 106, which may cause deterioration in image quality.

In the configuration according to the present exemplary embodiment, the generation of very small bubbles can also be reduced when the recording head 90 is filled with ink in such a use environment. The procedure for the ink filling method will be described below.

Figure 13A:
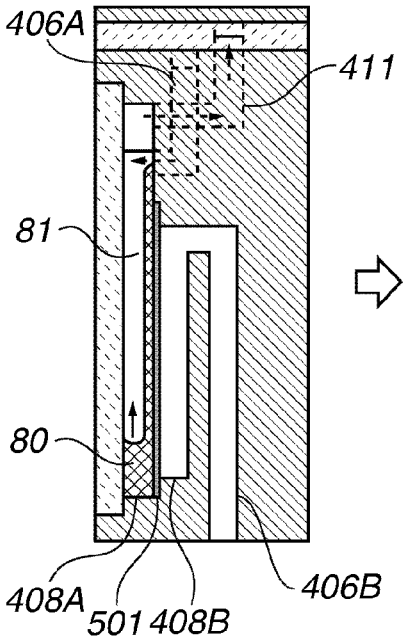
FIGS. 13A, 13B, 13C, 13D, 13E, and 13F are cross-sectional views for illustrating a method for filling the liquid discharge head according to the second exemplary embodiment with a liquid.
Figure 13B:
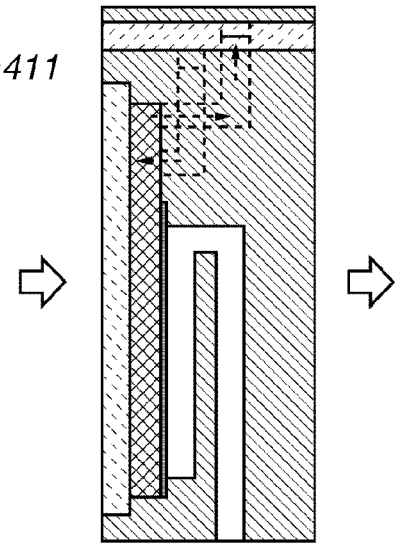
Figure 13C:
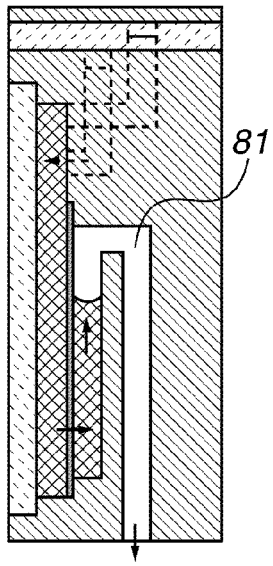
Figure 13D:
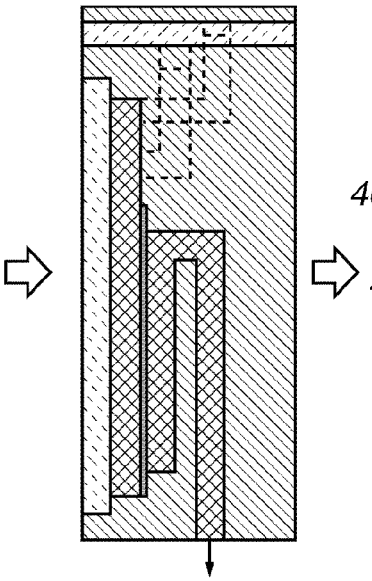
Figure 13E:
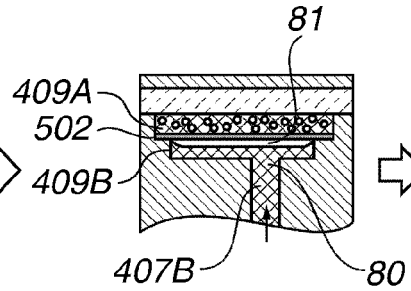
Figure 13F:
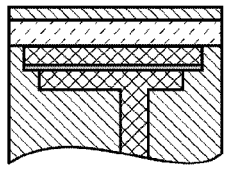

FIGS. 13A to 13F illustrate a behavior of ink 80 and bubbles 81 in an ink supply unit 400 when the recording head 90 is filled with the ink 80. An arrow illustrated in FIGS. 13A to 13F indicates an ink flow direction. FIGS. 13A to 13D are cross-sectional views of the ink supply unit 400 illustrated in FIG. 11 corresponding to a cross section taken along a line B-B illustrated in FIG. 2, and FIGS. 13E and 13F illustrate an upper portion of the ink supply unit 400 illustrated in FIG. 11 corresponding to a cross section taken along a line C-C illustrated in FIG. 2.

As a first step, the ink 80 is caused to flow from the first ink flow path 406A (fourth flow path) to the ink flow path 411, to fill the first containing chamber 408A with the ink 80. As illustrated in FIG. 13A, the ink 80 is supplied from the first ink flow path 406A, a liquid surface of the first containing chamber 408A rises, and air in the first containing chamber 408A is carried into the ink flow path 411. As illustrated in FIG. 13B, the first containing chamber 408A is filled with the ink 80. The air is carried into the ink tank 2 from the ink flow path 411, and is removed. A connection portion between the ink flow path 411 and the first containing chamber 408A is at a position higher than a connection portion between the first ink flow path 406A and the first containing chamber 408A. Therefore, the air can be easily discharged using buoyancy.

In the first step, when inner pressure of the first containing chamber 408A is increased, the ink 80 passes through a first filter 501 so that very small bubbles may be generated. Therefore, during the first step, the ink 80 may desirably be caused to flow only by suction through the ink flow path 411. At this time, pressure by suction may desirably be generated under the condition that air does not enter the first containing chamber 408A from the ink flow path 202. If the ink 80 is sucked through the ink flow path 411 and is pressurized from the first ink flow path 406A, the ink 80 may preferably be caused to flow under the condition that pressure by suction through the ink flow path 411 is greater.

Then, as a second step, the ink 80 is guided into the first filter 501, passes through the ink flow path 202 in the fixing member 200, and is guided out of a second filter 502 (ink flow in a direction indicated by an arrow B in FIG. 12). In this case, in an ink flow path portion within the recording apparatus 1, which communicates with the ink flow path 411, for example, its valve may be closed so that the ink 80 does not flow toward the ink flow path 411. The second step may be performed without waiting until the bubbles 81 are fed into the ink tank 2 in the recording apparatus 1 in the first step. As illustrated in FIG. 13C, the ink 80 passes through a lower portion of the first filter 501 the pressure of which becomes the highest. Therefore, the air and the ink 80 are not mixed with each other to pass through the first filter 501 so that very small bubbles are not easily generated because a portion on the upstream side of the first filter 501 is filled with the ink 80 in the first step.

A behavior of the ink 80 and the bubbles 81 is similar to that described in the second step in the first exemplary embodiment. The recording head 90 is filled with the ink 80, as illustrated in FIGS. 13D to 13F.

As described above, according to the second exemplary embodiment of the present invention, generation of very small bubbles in the ink flow path during ink filling can be reduced. Generation of bubbles can be reduced without performing a step of causing ink to flow in a direction opposite to that during the recording operation, which is described in the first exemplary embodiment. Therefore, the recording head 90 can easily be filled with ink.

In the present configuration, it is also possible to remove bubbles in the ink flow path upstream of the first filter 501 in an ink flow direction during the recording operation, including the ink flow path in the recording apparatus 1. Air dissolved in ink is changed into bubbles while the recording apparatus 1 is used for a long time so that the bubbles remain in the ink flow path or is fed into the first containing chamber 408A. If the bubbles accumulate in predetermined amounts or more, the effective area of the filter is reduced and a pressure loss is increased so that defective ink supply may occur. Therefore, the ink flow path 411 is used, like in the first step, for each predetermined usage time or while the recording operation is not being performed so that the bubbles in the ink flow path upstream of the first filter 501 can easily and quickly be removed.

While the ink flow path 411 communicates with the first containing chamber 408A, the ink flow path 411 may communicate with a second containing chamber 409A. In an ink filling method in this case, ink is first caused to flow from the ink flow path 407A to the ink flow path 411, to fill the second containing chamber 409A with the ink. Then, the step (see FIG. 9) illustrated in the first exemplary embodiment is performed so that generation of very small bubbles in the ink flow path can be reduced during the ink filling.

In the present exemplary embodiment, while two ink flow paths 5A and 5B are provided between the ink tank 2 and the recording head 90, a pump 3 is provided halfway in the ink flow path 5A connected to the first ink flow path 406A for supplying ink to the recording element substrate 100 (see FIG. 16).

Figure 14:
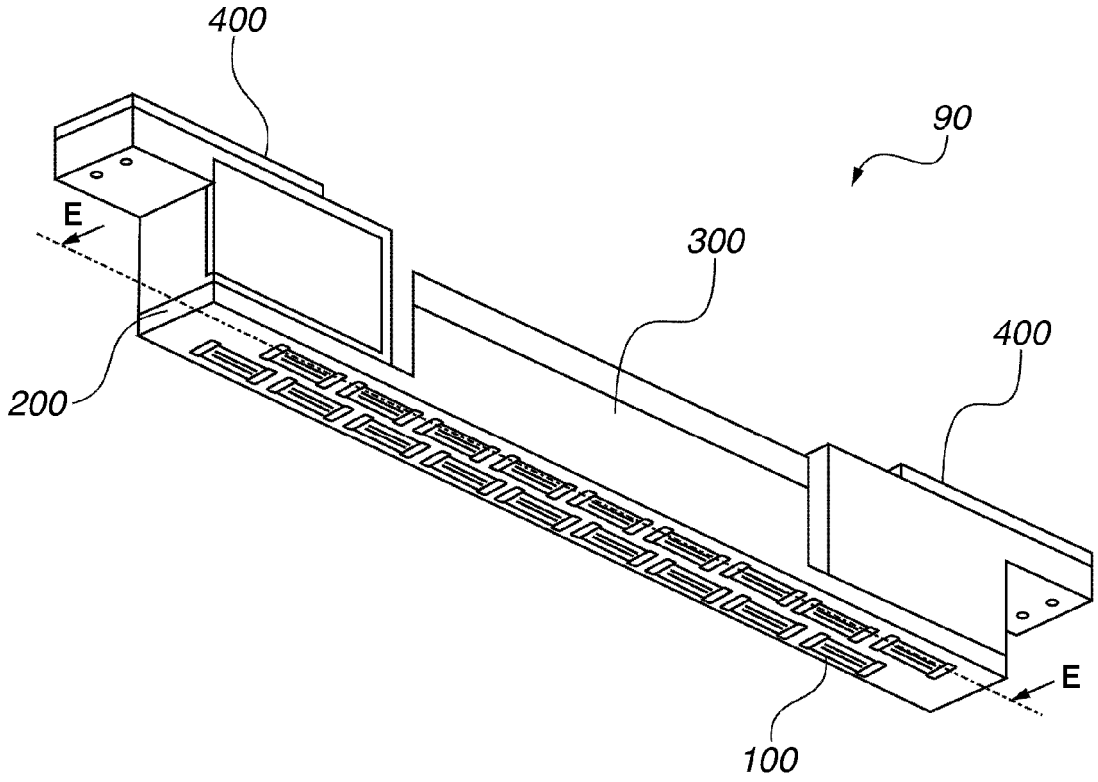
FIG. 14 is a perspective view illustrating a liquid discharge head according to a third exemplary embodiment of the present invention.
Figure 15:
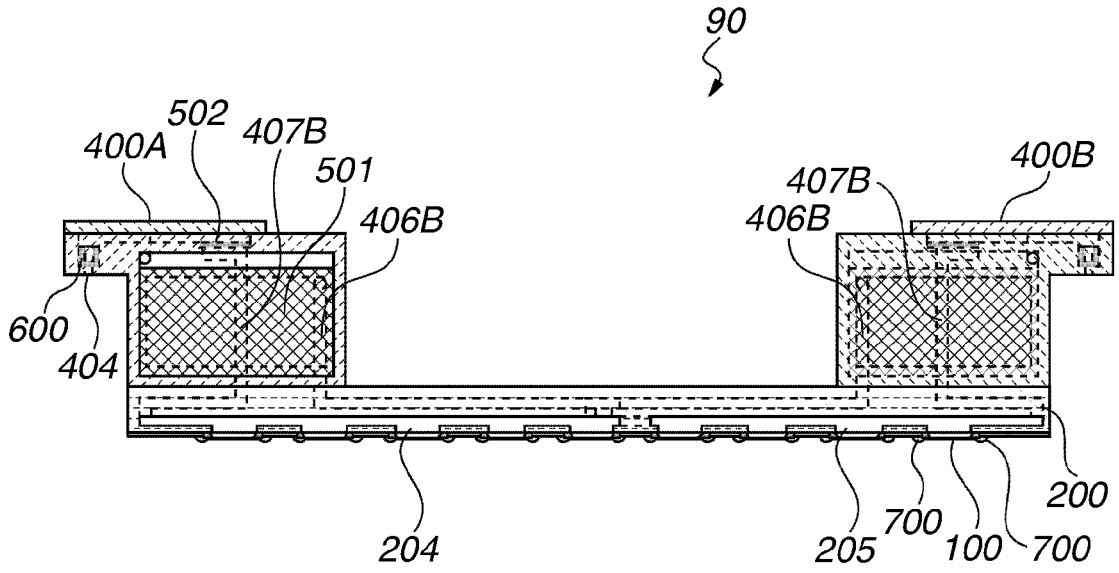
FIG. 15 is a cross-sectional view (a cross section taken along a line E-E illustrated in FIG. 14) illustrating the liquid discharge head according to the third exemplary embodiment.

FIG. 14 illustrates a recording head 90 in which the number of recording element substrates 100 disposed in a fixing member 200 is increased and which has a larger print width as a third exemplary embodiment of the present invention. FIG. 15 is a cross-sectional view taken along a line E-E illustrated in FIG. 14. The recording head 90 illustrated in FIG. 14 uses 18 recording element substrates 100, and has a print width of approximately 13 inches in its entirety.

If the print width is thus increased, an ink flow rate is further increased. Therefore, the area of a filter needs to be further increased. Thus, an ink supply unit 400 may increase in size. In the third exemplary embodiment, the recording head 90 has two ink circulation flow paths by disposing ink supply units 400, which are illustrated in the above-mentioned exemplary embodiments, at both ends of the recording head 90 in a direction in which discharge ports 106 are disposed. In a fixing member 200, a flow path 204 communicating with ink flow paths 406B and 407B in the one ink supply unit 400A and a flow path 205 communicating with ink flow paths 406B and 407B in the other ink supply unit 400B are formed. Thus, the third exemplary embodiment has a similar effect to those of the above-mentioned exemplary embodiments, and implements miniaturization of the ink supply unit 400.

While a full-line recording head has been described as a desirable exemplary embodiment of the present invention, the present invention is not limited to this. The present invention is optionally applicable to a recording head having a plurality of filters.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-112364 filed May 14, 2010, which is hereby incorporated by reference herein in its entirety.

What is claimed is:

1. A liquid discharge head, comprising:

a liquid discharge member including a plurality of discharge ports for discharging liquid, a plurality of energy generating elements generating energy for discharging liquid from the plurality of discharge ports, and a surface having a first opening and a second opening formed therein, the first and second openings communicating with the plurality of discharge ports; and a liquid supply member for supplying liquid to the liquid discharge member including:

a first filter having a filter surface extending substantially parallel with a gravitational direction and along a disposed direction in which the plurality of discharge ports are disposed;

a first containing chamber that contains the first filter;

a second filter having a filter surface having a smaller area than the area of the filter surface of the first filter;

a second containing chamber that contains the second filter;

a first flow path that connects the first opening and the first containing chamber; and a second flow path that connects the second opening and the second containing chamber, wherein the liquid supply member is joined to the surface of the liquid discharge member having the first and second openings formed therein such that the first flow path has one end aligned with the first opening, and the second flow path has one end aligned with the second opening, wherein the first filter has a length in the disposed direction which is smaller than a length of the liquid discharge member in the disposed direction, and wherein the second filter, the first flow path, and the second flow path are disposed in an area between a first surface perpendicular to the disposed direction and parallel to the gravitational direction and defined by one end of the first filter in the disposed direction, and a second surface parallel to the first surface and defined by the other end of the first filter in the disposed direction.

2. The liquid discharge head according to claim 1, wherein a length in the disposed direction of a portion in which the liquid discharge member and the liquid supply member are joined to each other is smaller than the length of the liquid discharge member in the disposed direction.

3. The liquid discharge head according to claim 1, wherein the first flow path and the second flow path are connected to the liquid discharge member so that liquid stored in a liquid storage chamber can be circulated via the liquid discharge member.

4. The liquid discharge head according to claim 3, wherein the second filter is disposed so that the filter surface of the second filter crosses the gravitational direction.

5. The liquid discharge head according to claim 1, wherein the first filter partitions an inside space of the first containing chamber into two portions, and a height of one of the two portions on the upstream side in a direction in which the liquid flows during a recording operation is larger than a height of the first filter in the gravitational direction.

6. The liquid discharge head according to claim 1, wherein the first filter is disposed to overlap with the filter surface of the second filter in the gravitational direction.

7. The liquid discharge head according to claim 1, wherein the first flow path is connected to an upper portion in the gravitational direction of the first containing chamber.

8. The liquid discharge head according to claim 1, wherein the liquid discharge member includes a liquid discharge substrate including the plurality of discharge ports and the plurality of energy generating elements, and a fixing member to which the liquid discharge substrate is fixed, and the fixing member includes a third flow path connected to the first opening and the second opening, and the first opening and the second opening communicate with the plurality of discharge ports via the third flow path.

9. The liquid discharge head according to claim 1, wherein the liquid supply member includes a casing for containing the first filter, the second filter, the first flow path, and the second flow path.

10. The liquid discharge head according to claim 1, wherein the first filter partitions an inside space of the first containing chamber into two portions, and a fourth flow path communicating with a liquid storage chamber that stores liquid and a fifth flow path communicating with the liquid storage chamber are connected to one of the two portions, which is not connected to the first flow path.

11. The liquid discharge head according to claim 10, wherein the fifth flow path is used when the liquid discharge head is filled with a liquid.

12. The liquid discharge head according to claim 11, wherein a connecting portion connecting the first containing chamber and the fifth flow path is provided above a connecting portion connecting the first containing chamber and the fourth flow path in the gravitational direction.

13. A liquid discharge apparatus having the liquid discharge head according to claim 4, comprising a control unit configured to control to guide liquid into the liquid discharge member by causing liquid to flow from the second filter toward the second opening and guide liquid out of the liquid discharge member by causing liquid to flow from the first opening toward the first filter, and then guide liquid into the liquid discharge member by causing liquid to flow from the first filter toward the first opening and guide liquid out of the liquid discharge member by causing liquid to flow from the second opening toward the second filter.

14. A liquid discharge apparatus comprising:

a liquid discharge member including a plurality of discharge ports for discharging liquid, a plurality of energy generating elements for generating energy for discharging liquid from the plurality of discharge ports, and a surface having a first opening and a second opening formed therein, the first and second openings communicating with the plurality of discharge ports;

a liquid supply member for supplying liquid to the liquid discharge member including:

a first filter having a filter surface extending substantially parallel with a gravitational direction when the liquid discharge member is used and along a disposed direction in which the plurality of discharge ports are disposed;

a first containing chamber that contains the first filter;

a second filter having a filter surface having a smaller area than the area of the filter surface of the first filter;

a second containing chamber that contains the second filter;

a first flow path that connects the first opening and the first containing chamber; and a second flow path that connects the second opening and the second containing chamber, wherein the liquid supply member is joined to the liquid discharge member such that one end of the first flow path is aligned with the first opening and one end of the second flow path is aligned with the second opening;

a liquid storage chamber configured to store liquid to be supplied to the liquid discharge member via the liquid supply member; and a circulation unit configured to circulate liquid in the liquid storage chamber via the first flow path, the liquid discharge member, and the second flow path, wherein the first filter has a length in the disposed direction which is smaller than a length of the liquid discharge member in the disposed direction, and wherein the second filter, the first flow path, and the second flow path are disposed in an area between a first surface perpendicular to the disposed direction and parallel to the gravitational direction and defined by one end of the first filter in the disposed direction, and a second surface parallel to the first surface and defined by the other end of the first filter in the disposed direction.

15. A liquid filling method for filling the liquid discharge head according to claim 4 with liquid, comprising:

firstly guiding liquid into the liquid discharge member by causing liquid to flow from the second filter toward the second opening and guiding liquid out of the liquid discharge member by causing liquid to flow from the first opening toward the first filter; and secondly guiding liquid into the liquid discharge member by causing liquid to flow from the first filter toward the first opening and guiding liquid out of the liquid discharge member by causing liquid to flow from the second opening toward the second filter after the first guiding step.

16. The liquid filling method for filling the liquid discharge head according to claim 10 with liquid, further comprising:

filling one of the two portions, which is not connected to the first flow path, with liquid by causing liquid to flow from the fourth flow path toward the fifth flow path; and guiding liquid into the liquid discharge member by causing liquid to flow from the first filter toward the first opening and guiding liquid out of the liquid discharge member by causing liquid to flow from the second opening toward the second filter after the filling.

* * * * *